US007410050B2

(12) United States Patent
Py et al.

(10) Patent No.: US 7,410,050 B2
(45) Date of Patent: Aug. 12, 2008

(54) CONTACT LENS STORAGE CONTAINER WITH NEEDLE PENETRABLE AND LASER RESEALABLE STOPPER, AND RELATED METHOD

(75) Inventors: Daniel Py, Larchmont, NY (US); Benoit Adamo, Brookfield, CT (US); John Guthy, Southbury, CT (US); Giovanni Rodriguez, Stamford, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 320 days.

(21) Appl. No.: 11/388,811

(22) Filed: Mar. 24, 2006

(65) Prior Publication Data

US 2006/0237335 A1 Oct. 26, 2006

Related U.S. Application Data

(60) Provisional application No. 60/665,428, filed on Mar. 24, 2005.

(51) Int. Cl.
*A45C 11/04* (2006.01)
*B65B 1/04* (2006.01)

(52) U.S. Cl. ..... 206/5.1; 53/467; 134/901

(58) Field of Classification Search ..... 206/5.1, 206/205, 210; 53/425, 431, 467, 471; 134/117, 134/901; 141/2, 329; 294/1.2; 422/113, 422/300, 301
See application file for complete search history.

(56) References Cited

U.S. PATENT DOCUMENTS 4,332,318 A * 6/1982 Feldman ..... 206/5.1
4,691,820 A 9/1987 Martinez
4,958,280 A 9/1990 Pauly
5,094,609 A * 3/1992 Kindt-Larsen ..... 206/5.1
5,159,360 A 10/1992 Stoy
5,222,522 A * 6/1993 Rontome ..... 206/5.1
5,488,815 A 2/1996 Abrams et al.
5,573,108 A 11/1996 Hamilton et al.
5,577,367 A 11/1996 Abrams et al.
5,578,331 A 11/1996 Martin et al.
5,609,246 A 3/1997 Borghorst et al.
5,620,087 A 4/1997 Martin et al.
5,675,962 A 10/1997 Martin et al.
5,687,541 A 11/1997 Martin et al.
5,722,536 A 3/1998 Pierce et al.
5,814,134 A 9/1998 Edwards et al.
5,882,687 A 3/1999 Park et al.
5,960,956 A 10/1999 Langanki et al.
6,000,534 A * 12/1999 Koomruian, Jr. ..... 206/5.1

(Continued)

FOREIGN PATENT DOCUMENTS

WO WO/97/20019 6/1997

(Continued)

*Primary Examiner*—Luan K Bui
(74) *Attorney, Agent, or Firm*—McCarter & English, LLP

(57) ABSTRACT

A contact lens container includes a body defining a cavity that is sized to hold a contact lens. A stopper is in fluid communication with the cavity and the stopper includes a resealable portion that is received into a channel. The resealable portion has a predetermined wall thickness in an axial direction thereof, the resealable portion defines a needle penetration region that is pierceable with a needle to form a needle aperture therethrough, and is heat resealable to hermetically seal the needle aperture.

21 Claims, 10 Drawing Sheets

U.S. PATENT DOCUMENTS

| | | | |
|---|---|---|---|
| 6,082,533 | A | 7/2000 | Smith et al. |
| RE37,432 | E | 11/2001 | Martin et al. |
| 6,364,098 | B2 | 4/2002 | Yavitz |
| 6,474,465 | B1 | 11/2002 | Jux |
| 6,634,753 | B1 | 10/2003 | Rozenman |
| 2004/0141886 | A1 | 7/2004 | Py et al. |
| 2004/0251146 | A1 * | 12/2004 | Church et al. ..... 206/5.1 |
| 2005/0045495 | A1 | 3/2005 | Dalsing et al. |

FOREIGN PATENT DOCUMENTS

| | | |
|---|---|---|
| WO | WO/03/039969 | 5/2003 |
| WO | WO/2005/011966 | 2/2005 |

* cited by examiner

CONTACT LENS STORAGE CONTAINER WITH NEEDLE PENETRABLE AND LASER RESEALABLE STOPPER, AND RELATED METHOD

CROSS-REFERENCE TO PRIORITY APPLICATION

This patent application claims priority on U.S. provisional patent application Ser. No. 60/665,428, filed Mar. 24, 2005 now abandoned, entitled "Apparatus and Method for Making an Ophthalmic Package", which is hereby expressly incorporated by reference in its entirety as part of the present disclosure.

FIELD OF THE INVENTION

The present invention relates to a contact lens storage container, also known as a blister package, having a needle penetrable and thermally resealable stopper for aseptically introducing a substance into the contact lens storage container through the stopper and thermally resealing the resulting penetration hole in the stopper, and to apparatus and methods for filling such a container.

BACKGROUND OF THE INVENTION

Referring to FIG. 1, a prior art blister package 10 includes a cavity 12 that receives a contact lens solution or "packing" solution and a contact lens within the solution. The cavity 12 is covered with a sealing flat covering layer (not shown) that is detachably sealed to a flange 14 that surrounds the cavity 12. The flange 14 of the blister package 10 defines gripping areas 16 that allow a user to grip the package and unseal the covering layer to access the contact lens stored within the cavity 12. The packing solution may have any of a variety of components, additives or other substances added thereto, such as physiologically compatible surfactants, cleaning agents, wetting agents, etc., as shown, for example, in U.S. Pat. No. 5,882,687. When manufacturing some such blister packages, the contact lens is placed within the cavity 12 together with the packing solution and any components, additives or other substances added thereto, and then the covering layer is sealed to the flange 14 to seal the contact lens, solution and any additives, etc. therein. The sealed package is then terminally sterilized, such as by the application of heat or gamma radiation thereto.

One of the drawbacks associated with such prior art blister packages and apparatus and methods for filling such packages is that the additives or other substances are introduced into the package prior to terminal sterilization. As a result, additives or other substances that can be damaged by terminal sterilization cannot be used. In other situations, terminal sterilization can negatively affect the additives or other substances and/or the solution or contact lens packaged with such additives or other substances.

Another drawback associated with prior art contact lens storage containers, and apparatus and methods for introducing additives, such as medicaments, to the containers, and/or to an eye after application of a contact lens to the eye, is that a substantial portion of the medicament or other additive is located on the external or convex surface of the contact lens. When the user blinks, the fluid within the eye, such as the tear film, can relatively rapidly flush away any such medicament or other additive located on the external or convex surface of the contact lens. The flushed medicament or other additive can flow into the lacryomo nasal duct (also referred to as the lachrymal nasal duct, i.e., a duct running between the base of the eye and the nasal passageway) which can, in turn, lead to systemic absorption of the flushed additive or other substance and, in some cases, give rise to systemic side effects.

Accordingly, it is an object of the present invention to overcome one or more of the above-described drawbacks and disadvantages of the prior art.

SUMMARY OF THE INVENTION

In accordance with a first aspect, the present invention is directed to a contact lens container for sealing within it a contact lens in a solution. The contact lens container is configured for use with an apparatus including a needle for penetrating the container and introducing through the needle a predetermined substance therein into contact with the contact lens and/or solution. A laser of the apparatus transmits radiation onto a penetrated region of the container to thermally reseal the penetrated region and, in turn, seal the contact lens, solution, and predetermined substance within the container. The container comprises a body defining a chamber; a contact lens and a contact lens solution received within the chamber; and a substantially fluid-tight seal formed between the chamber and ambient atmosphere to seal the contact lens and solution within the chamber. A needle penetrable and laser resealable stopper is located on the body in fluid communication with the chamber. The stopper is penetrable by the needle to introduce the predetermined substance through the needle and into the chamber, and a penetrated region of the stopper is thermally resealable by application of radiation from the laser thereto to reseal the stopper and, in turn, seal the contact lens, solution and predetermined substance within the chamber.

In one embodiment of the present invention, the needle penetrable and laser resealable stopper includes an inner layer in fluid communication with the chamber that is compatible with the contact lens, solution and the predetermined substance, and an outer layer that is needle penetrable and laser resealable. In one such embodiment, the inner layer does not leach more than a predetermined amount of leachables into the contact lens, solution and/or predetermined substance.

In one embodiment of the present invention, the body includes a base surface forming a base portion of the chamber. The base surface defines at least one substantially convex portion that supports a substantially concave surface of the contact lens thereon, and defines an interface therebetween. The interface is in fluid communication with the stopper for receiving the predetermined substance therein. Preferably, the interface contains a greater concentration of the predetermined substance than do the other portions of the chamber. In one such embodiment, the concave side of the contact lens defining the interface includes a greater concentration of the predetermined substance than does the opposing convex side of the contact lens. In one such embodiment, the base surface defines a plurality of relatively raised surface areas and relatively recessed surfaces areas between relatively raised surface areas. The relatively recessed surface areas are in fluid communication with the stopper for receiving predetermined substance therein. In one such embodiment, the relatively recessed surface areas are defined by substantially radially extending recesses, and the body further defines a fluid passageway in fluid communication between the recesses and the stopper for introducing the predetermined substance therethrough and into the recesses.

In one embodiment of the present invention, the predetermined substance is selected from the group including a preservative; a chelating agent; an anionic component; a cationic component; a zwitterionic component; an acid; a base; an alcohol; a glycol; a polymeric agent; a reducing agent; a salt; a surfactant; an antioxidant; a cleaning agent; a disinfecting agent; a wetting agent; a hydrating agent; a coloring agent; an ultraviolet absorbing agent; a gas; a lipid; an oil; a phospholipid; a lubricant; a buffering agent; a mineral; a nutrient; a vitamin; a biological macromolecule; a small molecule; an antibiotic; a biopolymer; a protein; and a nucleic acid.

In one embodiment of the present invention, the stopper includes a thermoplastic elastomer that is heat resealable to hermetically seal the penetrated region by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of the radiation through the predetermined wall thickness thereof, and (iii) a predetermined color and opacity that causes the laser radiation at the predetermined wavelength and power to hermetically seal the penetrated region in a predetermined time period of less than or equal to about 5 seconds and substantially without burning the stopper.

In one embodiment of the present invention, the stopper includes a thermoplastic elastomer that is heat resealable to hermetically seal the needle aperture by applying laser radiation at a predetermined wavelength and power thereto, and includes (i) a styrene block copolymer; (ii) an olefin; (iii) a predetermined amount of pigment that allows the second material portion to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and stopper during needle penetration thereof.

In one embodiment of the present invention, the stopper includes a thermoplastic elastomer that is heat resealable to hermetically seal the penetrated region thereof by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an mount that allows the second material portion to substantially absorb laser radiation at the predetermined wavelength and substantially prevent the passage of radiation through the predetermined wall thickness thereof, and hermetically seal the penetrated region in a predetermined time period of less than or equal to about 5 seconds; and (iv) a lubricant in an amount that reduces friction forces at an interface of the needle and stopper during needle penetration thereof.

In accordance with another aspect of the present invention, the contact lens container is part of an assembly including a filling apparatus comprising a needle manifold including a plurality of needles spaced relative to each other and movable relative to a container support for penetrating a plurality of containers mounted on the support within the filling apparatus, introducing the predetermined substance into the containers through the needles, and withdrawing the needles from the filled containers. The filling apparatus further includes a plurality of laser optic assemblies, wherein each laser optic assembly is connectable to a source of laser radiation, and is focused substantially on a penetration spot of a respective stopper for applying laser radiation thereto and resealing the respective penetrated region.

In accordance with another aspect, the present invention is directed to a contact lens container for sealing within it a contact lens in a solution. The container is configured for use with an apparatus including a needle for penetrating the container and introducing through the needle a predetermined substance therein into contact with the contact lens and/or solution. A laser of the apparatus transmits radiation onto a penetrated region of the container to thermally reseal the penetrated region and, in turn, seal the contact lens, solution, and predetermined substance within the container. The container comprises first means for forming a chamber; a contact lens and a contact lens solution received within the chamber; a substantially fluid-tight seal between the chamber and ambient atmosphere to seal the contact lens and solution within the chamber; and second means in fluid communication with the chamber for penetration by the needle to introduce the predetermined substance through the needle and into the chamber, and for thermal resealing by application of radiation from the laser thereto to reseal the second means and, in turn, seal the contact lens, solution and predetermined substance within the chamber.

In a currently preferred embodiment of the present invention, the first means is a body, and the second means is a needle penetrable and laser resealable stopper in fluid communication with the chamber that is penetrable by the needle to introduce the predetermined substance through the needle and into the chamber, and is thermally resealable by application of radiation from the laser thereto to reseal a penetrated region of the stopper and, in turn, seal the contact lens, solution and predetermined substance within the chamber.

In accordance with another aspect, the present invention is directed to a method of providing a contact lens container containing therein a contact lens and a solution, and adding thereto a predetermined substance. The method comprises the following steps:

(a) providing a contact lens container including a body defining a contact lens storage chamber, and a needle penetrable and laser resealable stopper in fluid communication with the chamber;
(b) introducing the contact lens and solution into the chamber, and sealing the contact lens and solution within the chamber relative to the ambient atmosphere;
(c) inserting a needle through the stopper and into fluid communication with the chamber;
(d) introducing the predetermined substance through the needle and into the chamber;
(e) withdrawing the needle from the stopper; and
(f) applying laser radiation to a penetrated region of the stopper, thermally resealing the penetrated region of the stopper and, in turn, sealing the contact lens, solution and predetermined substance within the chamber.

The method preferably further comprises the step of terminally sterilizing the contact lens container with the contact lens and solution sealed therein prior to introducing the predetermined substance into the container.

In one embodiment the method further comprises the step of introducing the predetermined substance into an interface formed between a substantially concave surface of the contact lens and a wall of the chamber, and (i) impregnating at least a portion of the predetermined substance into the concave surface of the contact lens, and/or (ii) depositing at least a portion of the predetermined substance onto the concave surface of the contact lens. In one such embodiment, the method further comprises the step of applying a greater amount of the predetermined substance to the concave side of the contact lens in comparison to the opposing convex side of the contact lens.

Also in one such embodiment, the method further comprises the step of applying the concave side of the contact lens into contact with a user's cornea such that a greater amount of the predetermined substance is located within the interface between the concave side of the contact lens and the eye in comparison to the opposite convex side of the contact lens.

One advantage of the present invention is that the predetermined substance can be aseptically introduced and sealed within the container after terminally sterilizing the contact lens and solution within the container, thus avoiding the problems encountered in the prior art in connection with introducing such predetermined substances into the container prior to terminal sterilization as described above. Yet another advantage of certain embodiments of the present invention is that a greater concentration of a predetermined substance can be introduced into and/or on the concave side of the contact lens, thus enabling a greater concentration of the substance to be sandwiched between the contact lens and the user's eye, and thereby allowing a relatively sustained release of the substance into the eye and substantially preventing the systemic absorption of the substance and negative side effects encountered in the prior art.

Other advantages of the present invention and/or of the currently preferred embodiments thereof will become more readily apparent in view of the following detailed description of the currently preferred embodiments and accompanying drawings.

DETAILED DESCRIPTION OF THE CURRENTLY PREFERRED EMBODIMENTS

Figure 1:
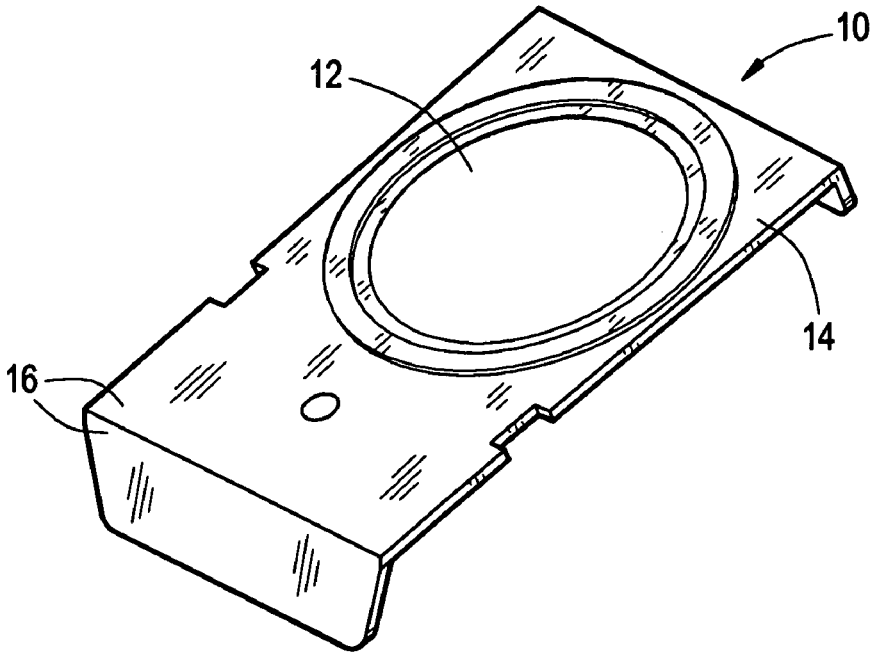
FIG. 1 (PRIOR ART)
FIG. 1 is a perspective view of a prior art blister package for storing a contact lens.
Figure 2:
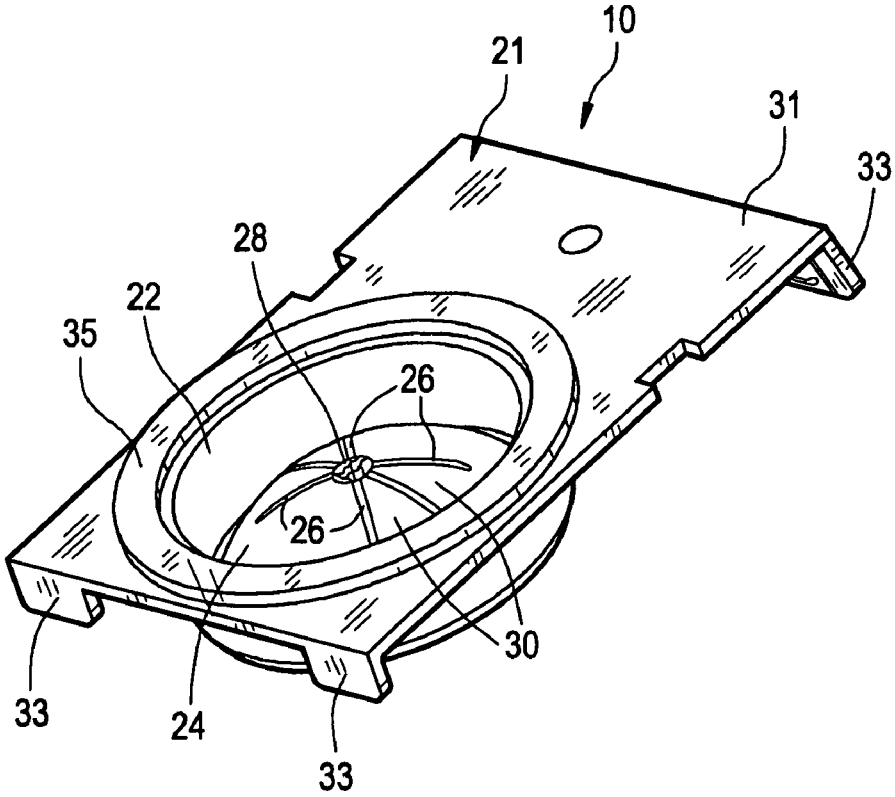
FIG. 2 is a top perspective view of a contact lens storage container according to an exemplary embodiment of the invention.
Figure 3:
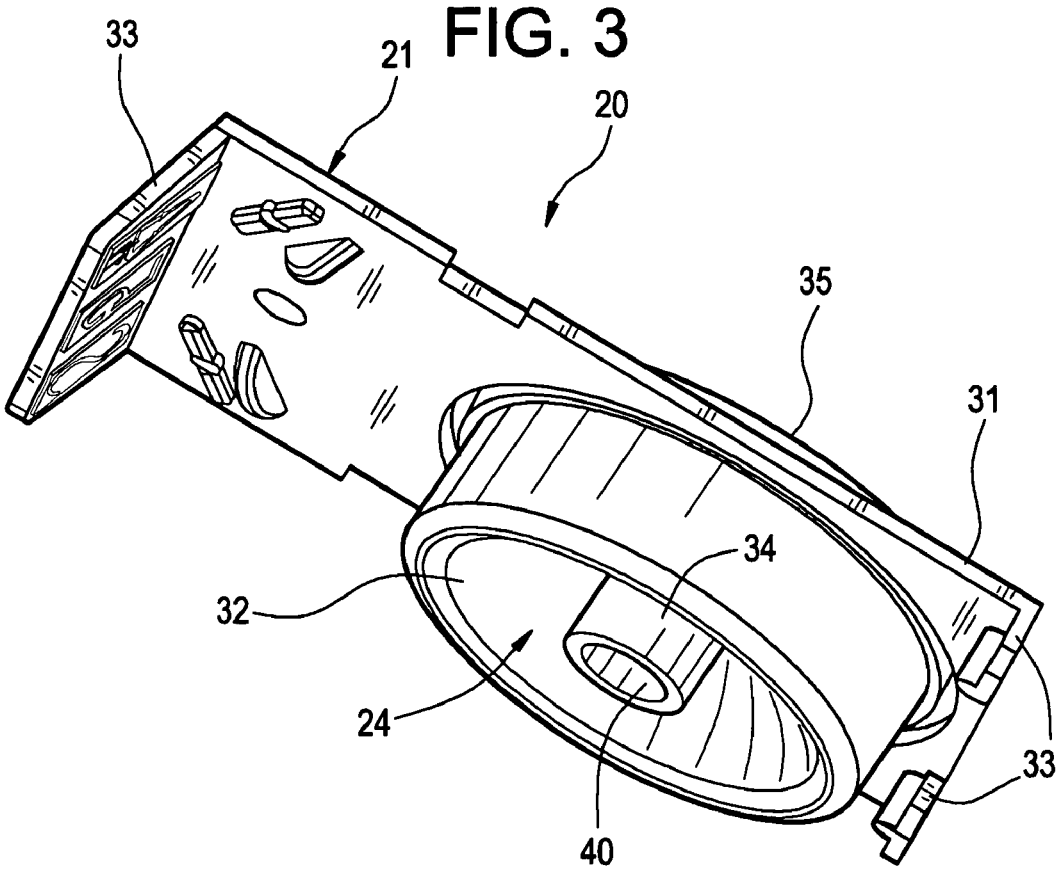
FIG. 3 is a bottom perspective view of the contact lens storage container of FIG. 2.

Referring to FIGS. 2-6, a contact lens storage container, also known as a blister package (referred to herein as a "contact lens storage container" or "container") is indicated generally by the reference numeral 20. The container 20 includes a body 21 defining a contact lens storage recess or cavity 22. In the illustrated embodiment, the base of the cavity 22 is defined by a substantially dome-shaped wall 24. The dome-shaped base 24 defines a plurality of radially extending recesses or slits 26 that are angularly spaced relative to each other, and a central recessed portion 28 in fluid communication with the radially extending recesses 26. As shown typically in FIG. 2, the base 24 defines a plurality of inner surface portions 30 extending between the radially extending recesses 26 and together forming a substantially dome-shaped or convex surface for supporting thereon a contact lens (not shown) received within the storage cavity 22. As shown typically in FIG. 3, the base 24 further defines on outer surface 32 located on an opposite side of the base wall relative to the inner surface 30.

The body 21 further defines a substantially planar flange 31 extending about the periphery of the storage cavity 22, and a plurality of tabs 33 extending downwardly from the end portions of the flange on opposite sides of the body relative to each other. One or more of the tabs 33 and/or the flange 31 define gripping areas that allow a user to grip the body to hold the container. The flange 31 of the body 21 defines a substantially circular raised sealing surface 35 that is located on the upper surface of the flange 31 and extends about the periphery of the storage cavity 22. As shown typically in FIG. 6, the container 20 further includes a removable sealing cover 37 that is sealed to the sealing surface 35 after loading the storage cavity 22 with a contact lens and packing solution to form a fluid tight or hermetic seal between the interior and exterior of the storage cavity. In one embodiment, the sealing cover 37 is a laminated foil cover, and an adhesive is used to releasably secure and seal the foil cover to the sealing surface 35 and/or flange 31, wherein both the foil cover and adhesive are of types known to those of ordinary skill in the pertinent art. As may be recognized by those of ordinary skill in the pertinent art based on the teachings herein, the body 21, cover 37, and mechanism for releasably sealing the cover to the body may take any of numerous different types or configurations that are currently known, or that later become known.

Figure 4:
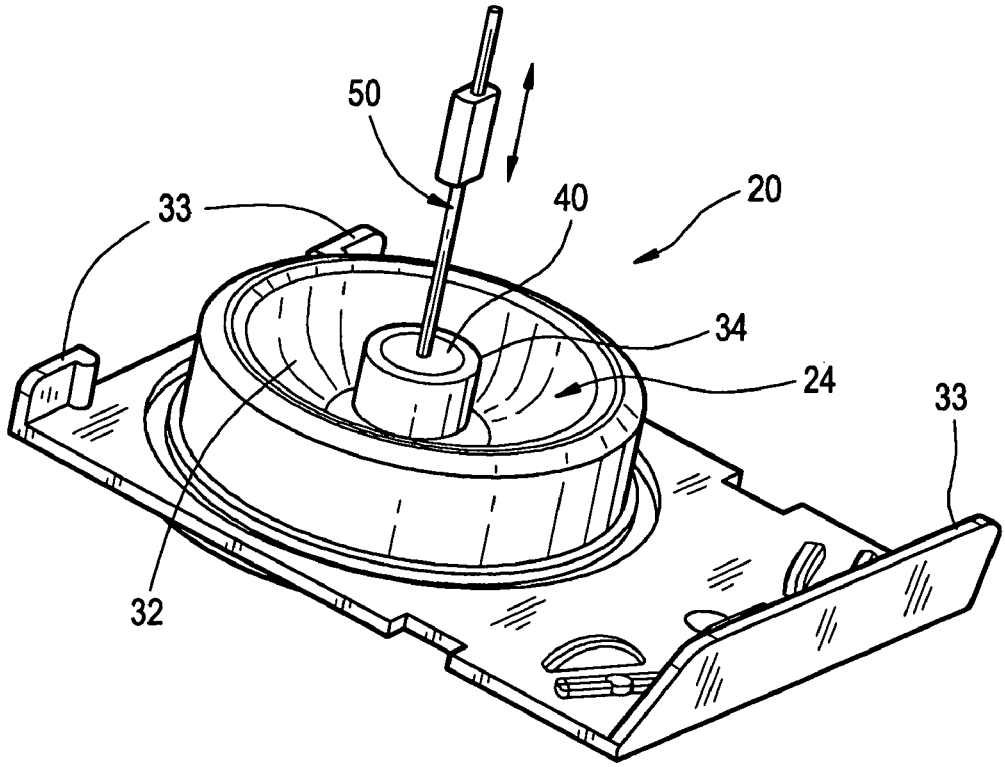
FIG. 4 is a bottom perspective view of the contact lens storage container of FIG. 2 showing a filling needle inserted into a resealable stopper of the container for introducing an additive or other substance into the container after terminal sterilization of the contact lens and packing solution therein.
Figure 5:
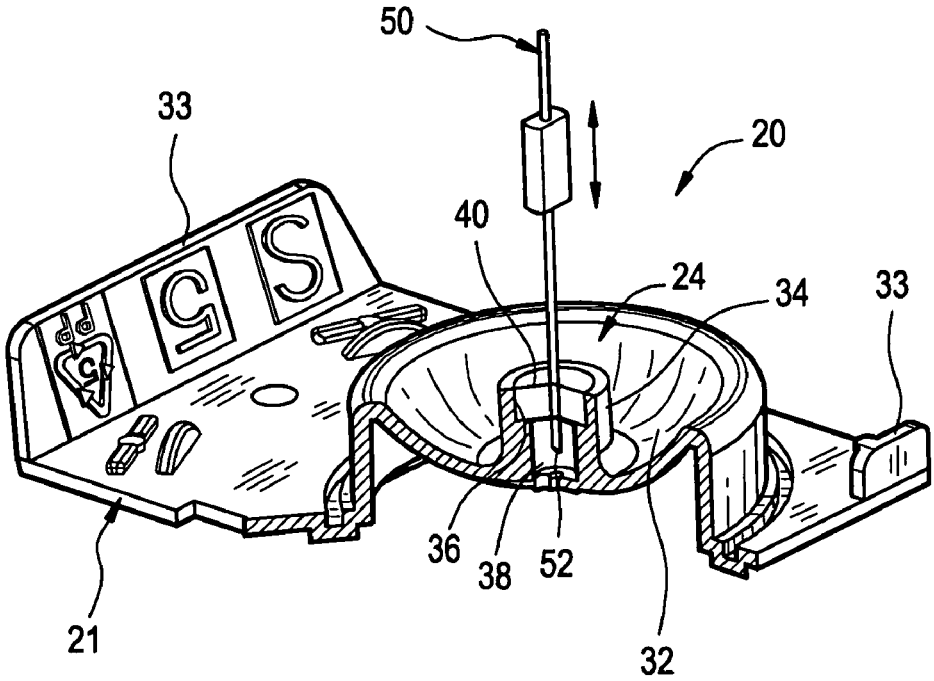
FIG. 5 is a perspective cross-sectional view of the contact lens storage container and filling needle of FIG. 4.

As shown in FIGS. 3-6, the body 21 further defines a filling boss 34 extending outwardly from a central region of the outer surface 32 of the base wall 24. As shown in FIG. 5, the filling boss 34 defines an internal stopper recess 36 formed in the end portion of the boss, and a fluid conduit or channel 38 extending through the boss and in fluid communication with the central region 28 and radially-extending recesses 26 of the base 24 and thus in fluid communication with the storage cavity 22. A resealable stopper 40 is received within the stopper recess 36 of the filling boss 34. As indicated further below, the stopper 40 and filling boss 34 may be formed in any of numerous different ways, out of any of numerous different materials, and may take any of numerous different configurations, that are currently known, or that later become known. For example, the stopper 40 can be inserted into the boss and fixedly secured thereto, such as by a locking ring or other locking member, or by an adhesive, or the stopper may be co-molded with the body, such as by over-molding the stopper to the body.

Figure 6:
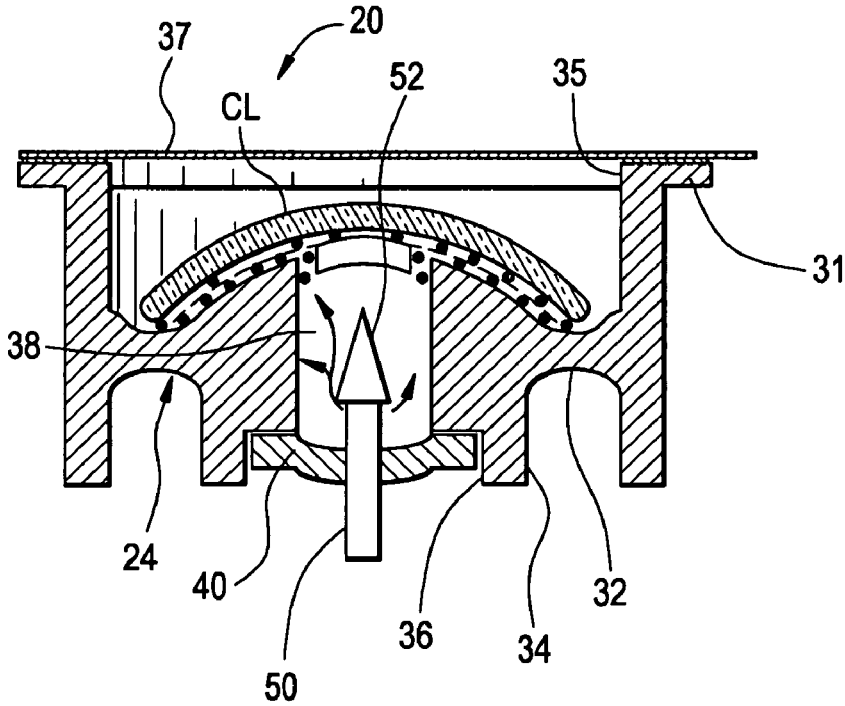
FIG. 6 is a somewhat schematic cross-sectional view of the contact lens storage container and filling needle of FIG. 4 showing the flow of additive and/or other substance from the filling needle, through the resealable stopper, and into the interface between the concave side of the contact lens and the base wall of the storage cavity of the container.

As shown typically in FIGS. 4-6, the resealable stopper 40 is penetrable by a hypodermic or other type of filling needle or injection member 50 that is inserted through the resealable stopper 40 such that the tip of the needle is received within the fluid channel 38 in order to dispense a substance, such as a medicament, into the cavity 22 and thus into the packing solution and/or into contact with the contact lens stored therein. In the illustrated embodiment, the fluid channel 38 is sized to allow for enough space for the bevel and filling aperture(s) of the filling needle to enter the channel and introduce the substance therein. As shown typically in FIG. 6, when the substance is injected through the needle 50 and into the channel 38, the substance flows through the central region 28 of the base wall 24, and into the radially-extending recesses 26. As a result, as shown typically in FIG. 6, the substance is deposited into the interface between the contact lens and the base wall. Once the desired amount of substance is introduced into the container 20, the needle 50 is withdrawn from the stopper 40, a heat or other energy source is applied to at least the portion of the resealable stopper 40 punctured by the needle 50 to, in turn, seal the punctured portion and hermetically seal the substance within the container. Thus, the substance may be added to the container 20 after the contact lens and packing solution and/or other components are sealed within the container and terminally sterilized.

One advantage of the illustrated embodiment of the invention is that a significantly greater amount of the substance can be introduced into the interface between the contact lens and the base wall 24 to thereby provide a greater concentration of the substance on the concave or inner side of the contact lens in comparison to the convex or outer side of the contact lens. Accordingly, when the contact lens is removed from the container 20 and applied to an eye, the portion of the contact lens containing the greater concentration of substance is placed into direct contact with cornea of the eye. The cornea can be a relatively slow absorbing region of the eye as compared to other regions of the eye, and thus the residence time of the substance on the eye for the substance located on the concave surface of the contact lens can be significantly greater than the residence time of any substance located on the convex side of the lens and therefore a relatively sustained release of the substance into the eye can be achieved. In addition, the draining of substantial amounts of the substance into the nasal ducts and the associated systemic absorption of such substances as encountered in the prior art can be substantially avoided.

However, as may be recognized by those of ordinary skill in the pertinent art based on the teachings herein, the substance be introduced into all regions of the storage cavity, can be introduced into selective regions of the storage cavity, can be substantially uniformly applied to all surfaces of the contact lens, can be applied to substantially only select surfaces of the contact lens, and/or can be selectively applied in different concentrations to different surfaces or different surface regions of the contact lens. For example, if the surface of the lens that is concave when located in an eye is normally convex when located in the storage container, a greater concentration of the substance can be applied to the convex surface of the lens when located in the storage container.

After injecting the container 20 with the substance and withdrawing the needle 50 from the stopper 40, the penetrated region of the stopper defines a needle hole along the path of the withdrawn needle. Upon withdrawing the needle, the material of the resealable stopper may be sufficiently resilient to close upon itself in the penetrated region and thereby maintain the container in a sealed condition. However, as described above, vapors, gases and/or liquid may be allowed over time to pass through the needle hole, and therefore container is passed through a sealing station, as shown and described below with reference to FIG. 11, to reseal the resulting needle hole in the stopper 40 after withdrawing the needle therefrom. When the 40 is heated by a laser or other such thermal or radiation source, and maintained at a sufficient temperature, the material of the resealable stopper fuses and reseals the needle hole. As a result, the needle hole is eliminated from the exterior region of the resealable stopper to thereby maintain a hermetic seal between the interior and exterior of the storage cavity.

Figure 7:
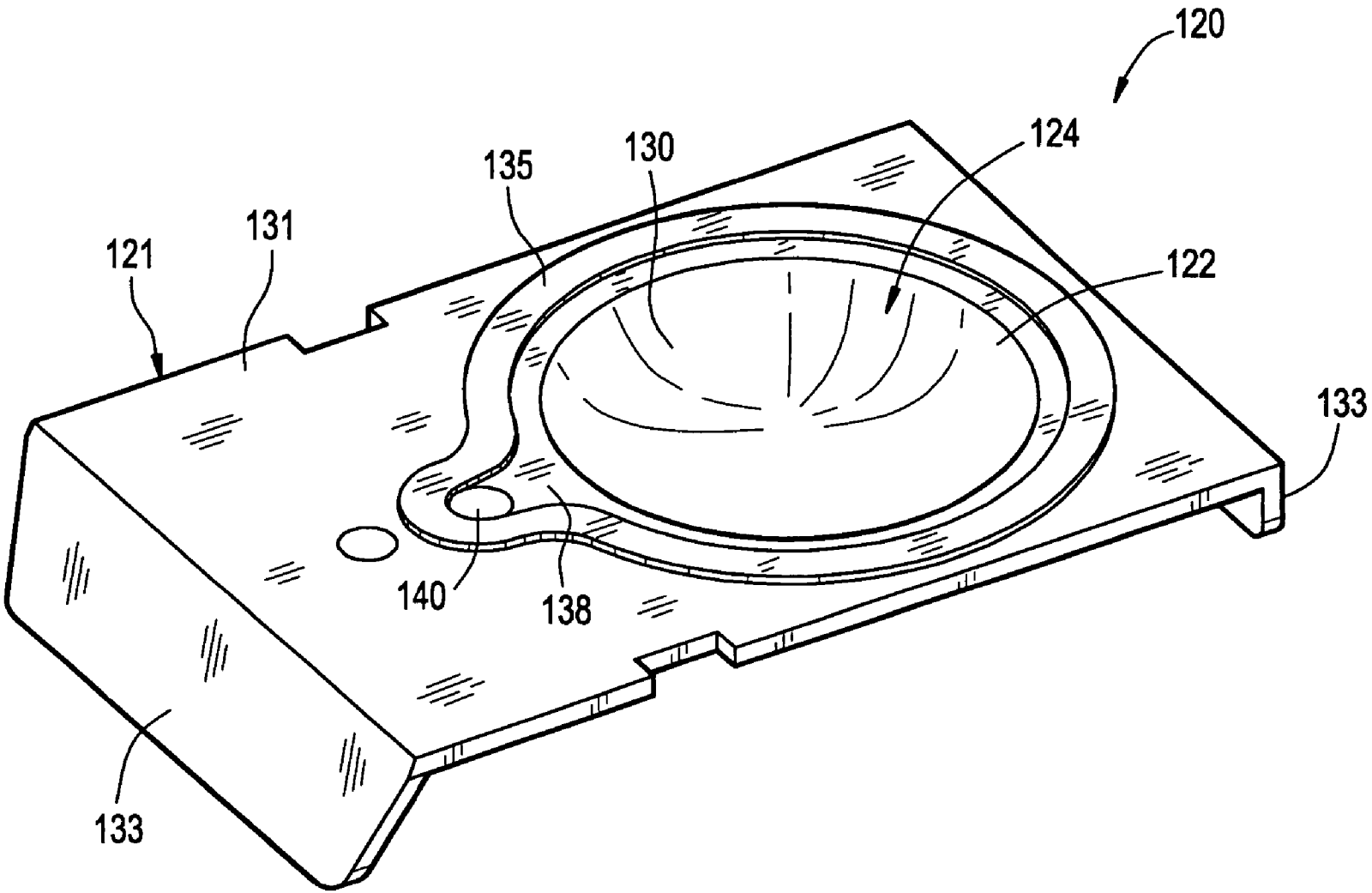
FIG. 7 is a top perspective view of a second embodiment of a contact lens storage container according to an exemplary embodiment of the invention.
Figure 8:
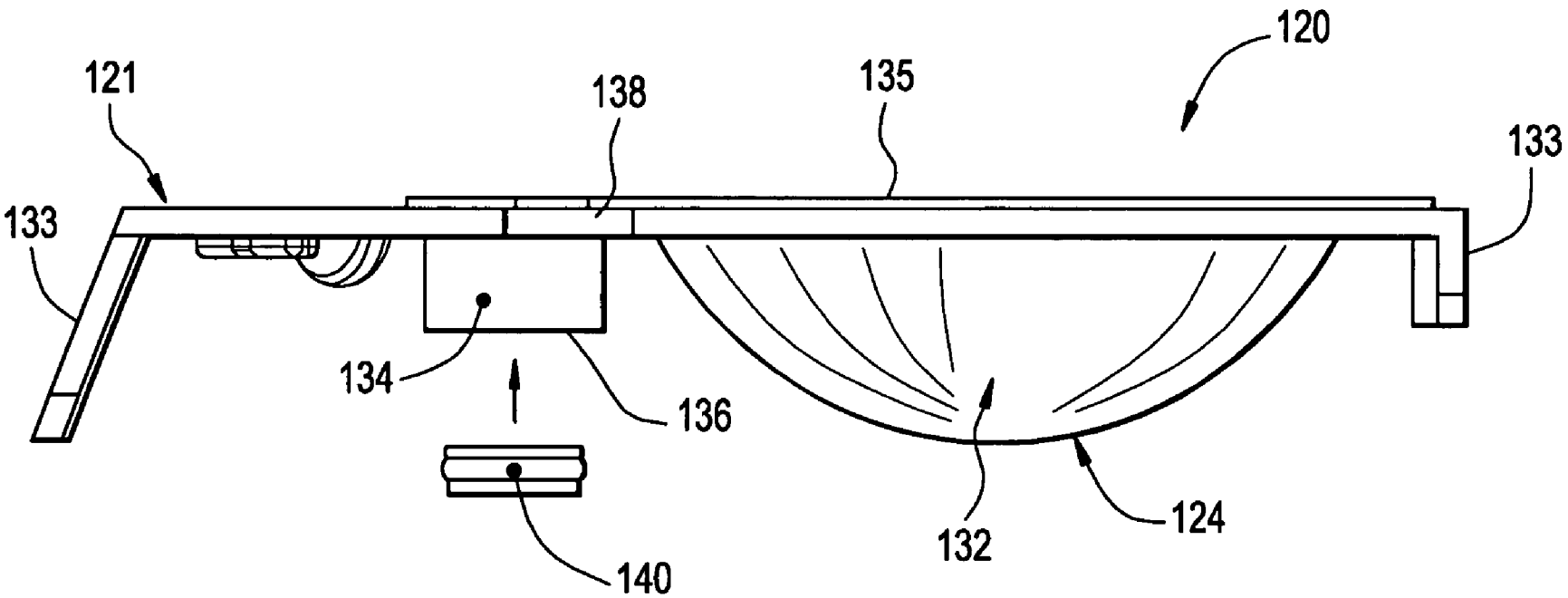
FIG. 8 is an exploded side elevational view of the contact lens storage container of FIG. 7.
Figure 9:
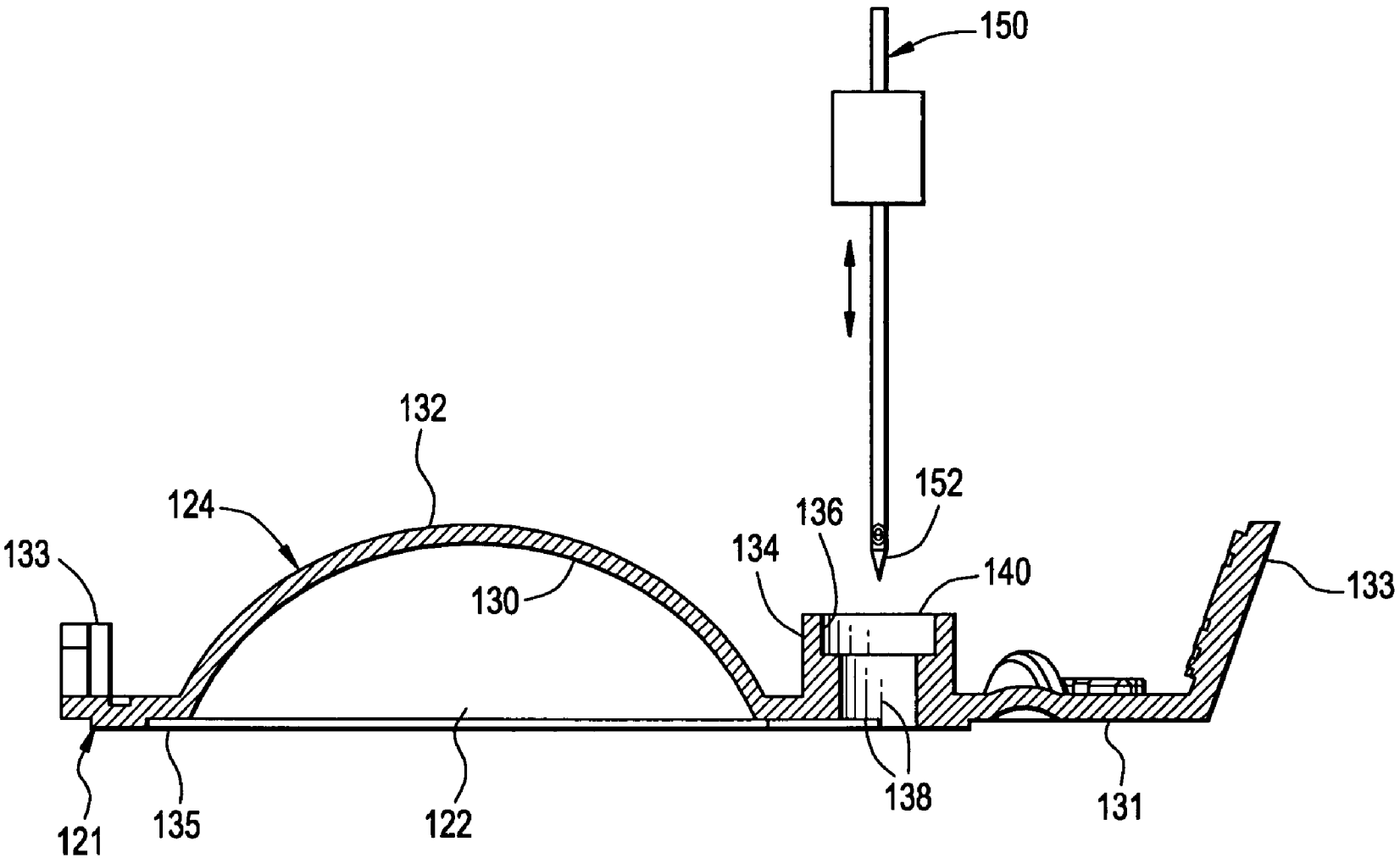
FIG. 9 is another side elevational view of the contact lens storage container of FIG. 7 showing the filling needle adjacent to the resealable stopper.

Referring to FIGS. 7-9, another exemplary embodiment of a contact lens storage container of the invention is indicated generally by the reference numeral 120. The contact lens storage container 120 is substantially similar to the container 20 described above with reference to FIGS. 2-6, and therefore like reference numerals preceded by the number "1" are used to indicate like elements. A primary difference of the container 120 in comparison to the container 20 above is that the filling boss 134 and stopper 40 are spaced laterally relative to the storage cavity 122, and the fluid channel 138 extends laterally between the inner surface of the stopper 140 and the storage cavity 122. Also in this embodiment, the interior surface 130 of the base wall 124 of the storage cavity 122 defines a substantially smooth concave shape as in certain prior art contact lens storage containers. When the substance is introduced through a needle (not shown) that penetrates the stopper, the substance flows through the channel 138 and into the cavity 122. Because the base wall 130 of the cavity is substantially convex, the substance flows into contact with the concave side of the contact lens. Accordingly, this embodiment can facilitate forming a greater concentration of the substance on the inner or concave side of the contact lens that contacts the eye as opposed to the outer or convex side of the contact lens. Another advantage of this embodiment is that the tooling used to mold and/or assemble prior art containers can be modified to form the containers of the invention.

Figure 10:
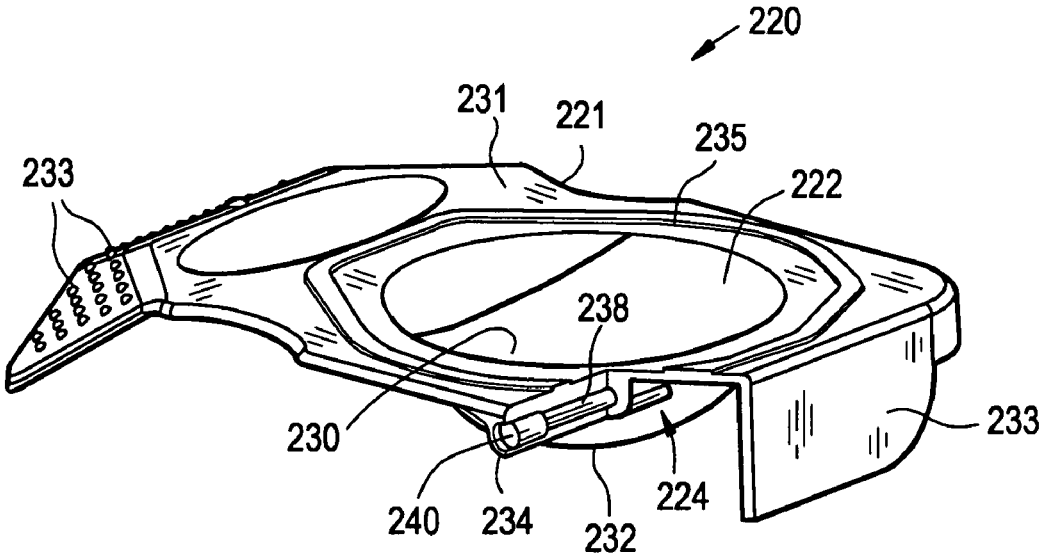
FIG. 10 is a top perspective view of a third embodiment of a contact lens storage container according to an exemplary embodiment of the invention.

Referring to FIG. 10, another exemplary embodiment of a contact lens storage container of the invention is indicated generally by the reference numeral 220. The contact lens storage container 220 is substantially similar to the containers 20 and 120 described above, and therefore like reference numerals preceded by the number "2", or preceded by the numeral "2" instead of the numeral "1", are used to indicate like elements. A primary difference of the container 220 is that the stopper 240 is located at an edge 238 of the container. The channel 236 connects the stopper 40 in fluid communication with the cavity 222. When the substance is introduced through a needle (not shown) that penetrates the stopper, the substance flows through the channel 238 and into the cavity 222. Because the base wall 230 of the cavity is substantially convex, the substance flows into contact with the concave side of the contact lens. Accordingly, this embodiment can facilitate forming a greater concentration of the substance on the inner or concave side of the contact lens that contacts the eye as opposed to the outer or convex side of the contact lens.

The substance that is injected through the stopper 40 can be an active pharmaceutical ingredient, such as any of the following non-limiting examples: a preservative; a chelating agent, for example, EDTA; an anionic component; a cationic component; a zwitterionic component; an acid; a base; an alcohol; a glycol; a polymeric agent; a reducing agent; a salt, comprised of, for example sodium, calcium, magnesium, phosphate or chloride; a surfactant; an antioxidant; a cleaning agent; a disinfecting agent; a wetting agent; a hydrating agent; a coloring agent; an ultraviolet absorbing agent; a gas, for example, nitrogen, oxygen, or carbon dioxide; a lipid; an oil; a phospholipid; a lubricant; a buffering agent; a mineral; a nutrient; a vitamin; or a drug, for example, a biological macromolecule, a small molecule, or an antibiotic; or a biopolymer, such as a peptide, a protein, for example an enzyme, or a nucleic acid. As may be recognized by those of ordinary skill in the pertinent art based on the teachings herein, the substance also may be any of numerous different pharmaceutical ingredients or other substances that are currently known, or that later become known, that can be deposited onto and/or absorbed into one or more surfaces of a contact lens, or that can be introduced into the packing solution for the contact lens. In addition, the packing solution may take any the form of any of numerous different contact lens solutions that are currently known or that later become known, including with limitation saline solutions and/or cleaning solutions.

Figure 11:
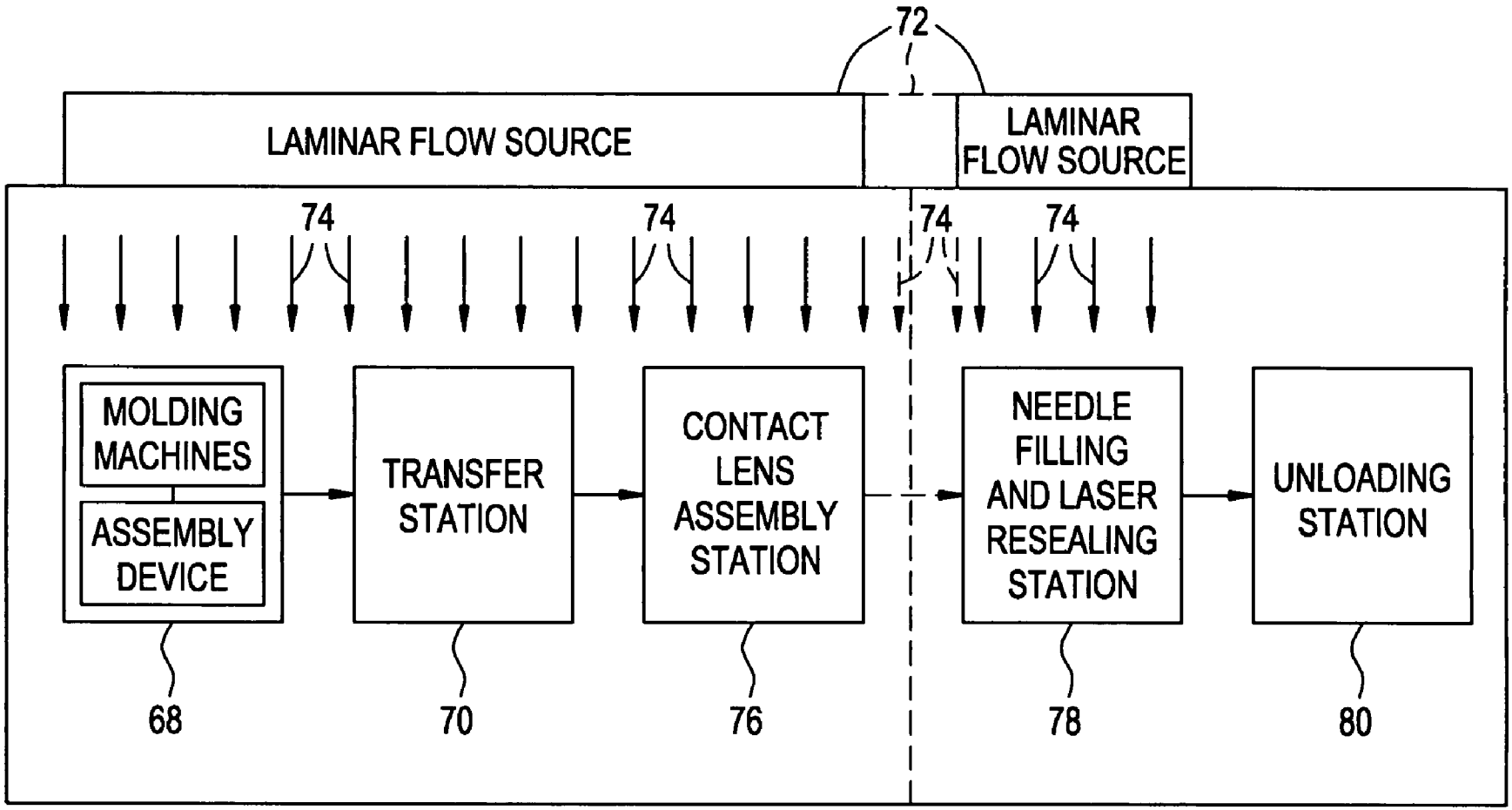
FIG. 11 is a schematic illustration of an exemplary embodiment of an apparatus of the present invention for molding, assembling, needle filling and laser resealing contact lens storage containers.

If desired, and with reference to FIG. 11, the stopper 40 can be co-molded with body 21, such as by over-molding the stopper to the body in a molding machine 68. Alternatively, the stopper 40 may be molded in the same mold as the container body 21, and at least one of the stopper and the body may be assembled within or adjacent to the mold in accordance with the teachings of commonly-assigned U.S. patent application Ser. Nos. 11/074,454 and 11/074,513 incorporated by reference below, and U.S. Provisional Patent Application Ser. No. 60/727,899 filed Oct. 17, 2005, entitled "Sterile De-Molding Apparatus And Method", which is hereby expressly incorporated by reference as part of the present disclosure. However, as may be recognized by those of ordinary skill in the pertinent art, the stopper and body can be molded and assembled in any of numerous different ways that are currently known, or that later become known. As also shown in FIG. 11, the assembled stoppers and container bodies are fed into a transfer station 70. Preferably, the laminar flow source 72 directs a substantially laminar flow 74 of sterile air or other gases over the assembled stopper and container bodies during molding, transfer and contact lens assembly.

The transfer station 70 may include any of numerous different types of container conveying systems that are currently known or that later become known for performing the function of transporting the assembled containers 20 therethrough. For example, the conveying system may include a vibratory feed table or tray or other input device for receiving the assembled containers 20 into the transfer station 70, and one or more conveying systems operatively coupled to the input device for transporting the containers therefrom in a single file or other desired configuration. For example, the conveying system may include a vibratory feed system, a closed loop conveyor, or a rotatably driven lead screw. As may be recognized by those or ordinary skill in the pertinent art based on the teachings herein, the conveying system may take the form of any of numerous different conveying systems that are currently known or that later become known.

The contact lens and hydrating solution are added to the container 20 at a contact lens assembly station 76. In addition, the container 20 is sealed with a foil or other cover 37 (FIG. 6), as is known in the art. While these steps have been shown as occurring at one step within the contact lens assembly station, it is understood that these steps may also occur separately, at separate stations. The container 20 is then terminally sterilized, such as by exposing the assembly to heat, beta and/or gamma radiation in a manner known to those of ordinary skill in the pertinent art. After sterilizing, the exposed end of the stopper 42 may be covered with a cap and/or sealing member so that the exposed end of the stopper 42 remains sterile when the container 20 is moved from one location to another. As may be recognized by those of ordinary skill in the pertinent art based on the teachings herein, the containers can be terminally sterilized in any of numerous different ways that are currently known, or that later become known.

Each container 20 including the contact lens and solution aseptically sealed within the container, is then needle filled with a predetermined substance through the stopper 40 and the resulting needle hole in the stopper is thermally resealed in accordance with the teachings of any of the following patent applications and patents that are hereby incorporated by reference in their entireties as part of the present disclosure: U.S. patent application Ser. No. 10/766,172 filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same"; U.S. patent application Ser. No. 10/983,178 filed Nov. 5, 2004, entitled "Adjustable Needle Filling and Laser Sealing Apparatus and Method; U.S. patent application Ser. No. 11/070,440 filed Mar. 2, 2005, entitled "Apparatus and Method for Needle Filling and Laser Resealing"; U.S. patent application Ser. No. 11/074,513 filed Mar. 7, 2005, entitled "Apparatus for Molding and Assembling Containers with Stoppers and Filling Same; and U.S. patent application Ser. No. 11/074,454 filed Mar. 7, 2005, entitled "Method for Molding and Assembling Containers with Stoppers and Filling Same".

In accordance with such teachings, the needle filling and laser resealing station 78 comprises a needle manifold including a plurality of needles 50 spaced relative to each other and movable relative to a conveyor holding the containers 20 for penetrating a plurality of containers 20 mounted on the portion of the conveyor within the filling station, introducing the predetermined substance into the containers through the needles, and withdrawing the needles from the filled containers. The laser resealing station comprises a plurality of laser optic assemblies, and each laser optic assembly is located over a respective container position of the conveyor located within the respective laser resealing station. Each laser optic assembly is connectable to a source of laser radiation, and is focused substantially on a penetration spot on the stopper of the respective container 20 for applying laser radiation thereto and resealing the respective needle aperture. The laser resealing station may preferably further comprise a plurality of optical sensors. Each optical sensor is mounted adjacent to a respective laser optic assembly and is focused substantially on the laser resealed region of a stopper of the respective laser optic assembly, and generates signals indicative of the temperature of the laser resealed region to thereby test the integrity of the thermal seal.

Figure 12:
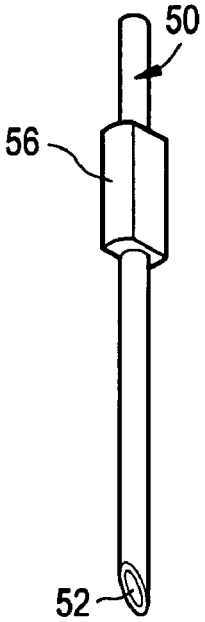
FIG. 12 is a perspective view of a first exemplary embodiment of a filling needle used in the apparatus of FIG. 11 for needle filling the contact lens storage containers.
Figure 13:
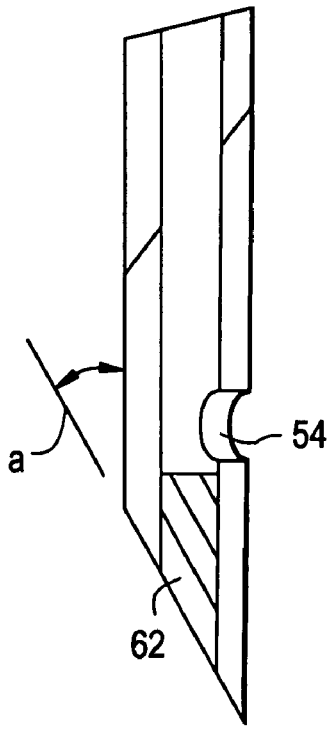
FIG. 13 is a cross-sectional view of a tip portion of the needle of FIG. 12.

As disclosed above, the needle 50 is used to inject a substance into the container 20. In particular, referring to FIGS. 12 and 13, a first embodiment of a needle 50 has a pointed, non-coring tip 52 in which an angle a of the tip 52 relative to the body of the needle 50 in cross-section is within the range of about 25° to about 35°, preferably about 28° to about 32°, and most preferably about 30°. The smooth, sharply-pointed, gradually increasing angle of the needle tip allows for a relatively smooth, and gradual expansion of the needle hole upon penetrating the stopper. Further, the memory of the preferred thermoplastic blends of the stopper causes the needle hole to substantially close on itself upon withdrawing the needle therefrom, thus reducing the requisite area of impingement by the laser beam for resealing, and reducing cycle time. In addition, this further reduces the possibility of contaminating the interior of the container between needle filling and laser resealing. If desired, the stopper surface may be Teflon coated or otherwise coated with a low-friction material to further reduce friction, and thus the formation of particles, at the needle/stopper interface.

The needle tip further defines axially oblong flow aperture 54 on a side of the needle 50. The aperture 54 is located approximately a distance "d" from an end of the tip 52 of the needle 50. The distance "d" can range from about 0.01 inch to about 0.05 inch and in an exemplary embodiment is about 0.038 inch. The fluid in the needle 50 flows out the aperture 54 because an end of the needle 50 is blocked with a pin 62 that may be laser welded into the opening. The pin 62 allows for the needle 50 to be non-coring. In an exemplary embodiment, the needle width is about 0.016 inch diameter. A bushing 56 is welded onto the outside diameter of the needle 50 so that needle 50 can be easily mounted in a machine.

Figure 15:
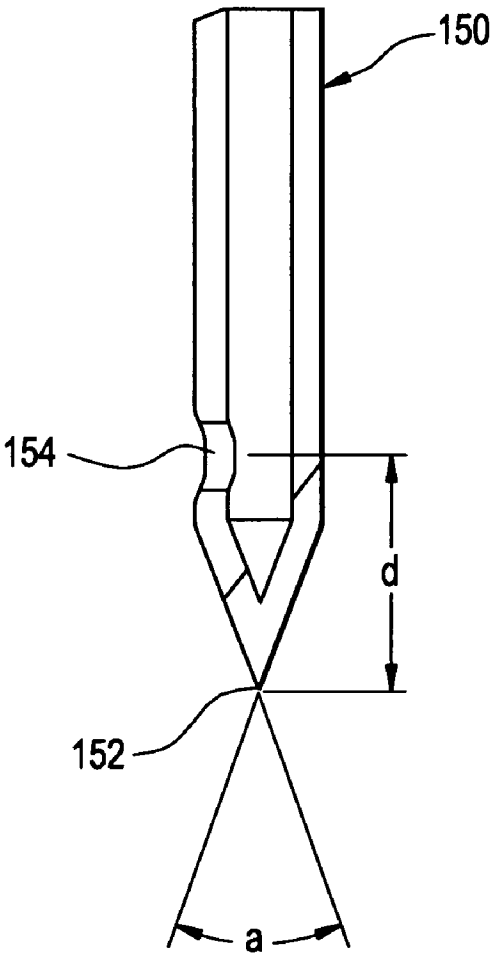
FIG. 15 is a cross-sectional view of a tip portion of the needle of FIG. 14.
Figure 14:
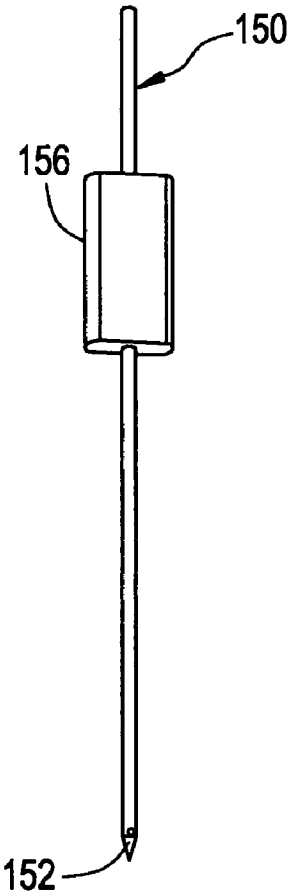
FIG. 14 is a perspective view of a second exemplary embodiment of a filling needle used in the apparatus of FIG. 11 for needle filling the contact lens storage containers.

Referring to FIGS. 14 and 15, another exemplary embodiment of a needle 150 is illustrated. The needle 150 is similar to the needle 50 described above, and therefore like reference numerals preceded by the numeral "1" are used to indicate like elements. The needle 150 has a conically-pointed, non-coring tip 152 (i.e., a "pencil point" tip), wherein the included angle a of the tip in cross-section is within the range of about 30° to about 50°, preferably about 37° to about 43°, and most preferably about 40°. The needle tip further defines at least one axially oblong flow aperture 154 on a side of the needle 150. The aperture 154 is located approximately a distance "d" from an end of the tip 152 of the needle 150. The distance "d" can range from about 0.01 inch to about 0.05 inch and in an exemplary embodiment is about 0.030 inch.

Figure 17:
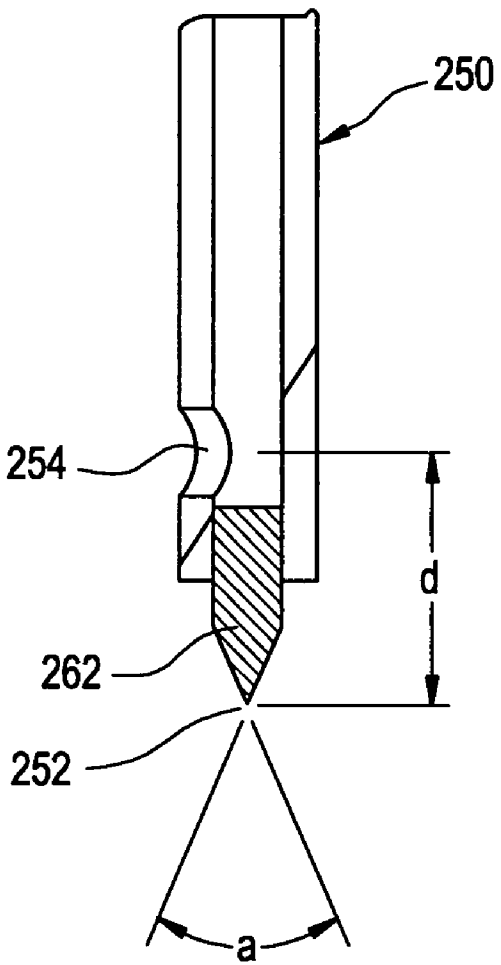
FIG. 17 is a cross-sectional view of a tip portion of the needle of FIG. 16.
Figure 16:
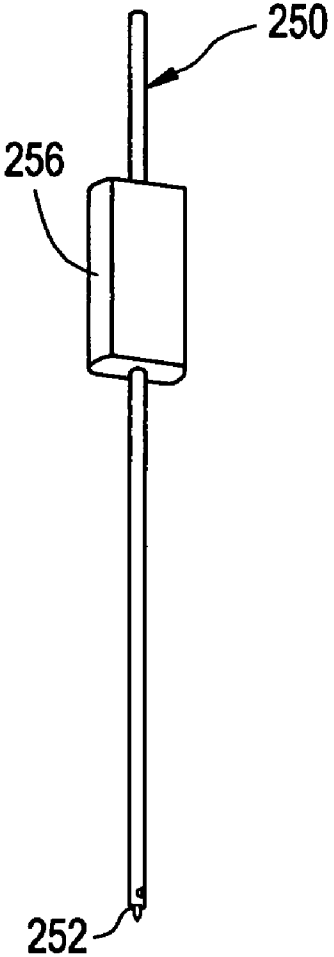
FIG. 16 is a perspective view of a second exemplary embodiment of a filling needle used in the apparatus of FIG. 11 for needle filling the contact lens storage containers.

Referring to FIGS. 16 and 17, another exemplary embodiment of a needle 250 is illustrated. The needle 250 is similar to the needles 50 and 150 described above, and therefore like reference numerals preceded by the numeral "2" are used to indicate like elements. The needle 250 has a conically-pointed, non-coring tip 252 (i.e., a "pencil point" tip), wherein the included angle "a" of the tip in cross-section is within the range of about 33° to about 63°, preferably about 50° to about 56°, and most preferably about 53°. The needle tip further defines at least one axially oblong flow aperture 254 on a side of the needle 250. The aperture 254 is located approximately a distance "d" from an end of the tip 252 of the needle 250. The distance "d" can range from about 0.01 inch to about 0.05 inch and in an exemplary embodiment is about 0.030 inch. The fluid in the needle 250 flows out the aperture 254 because an end of the needle 250 is blocked with a pin 262 that may be laser welded into the opening, which allows for the needle to be non-coring.

In an exemplary embodiment, the needle/stopper interface is treated to reduce the degree of friction therebetween to further reduce the formation of particles during the needle stroke. In one embodiment, the needle is tungsten carbide carbon coated. In another embodiment, the needle is electropolished stainless steel. In another embodiment, the needle is Teflon coated. In yet another embodiment, the needle is titanium coated to reduce friction at the needle/stopper interface. In another embodiment, grooves are formed in the outer surface of the needle to vent the displaced gas from the chamber. In one such embodiment, a cylindrical sleeve surrounds the grooves to prevent the stopper material from filling or blocking the grooves (partially or otherwise) and thereby preventing the air and/or other gases within the container from venting therethrough. As may be recognized by those of ordinary skill in the pertinent art based on the teachings herein, the non-coring needles may be made in any of numerous different ways, and may take any of numerous different configurations that are currently known, or that later become known.

In the illustrated embodiment of the present invention, the stopper 40 is preferably made of a thermoplastic/elastomer blend, and may be the same material as those described in the co-pending patent applications and/or patents incorporated by reference above. Accordingly, in one such embodiment, the stopper 40 is a thermoplastic elastomer that is heat resealable to hermetically seal the needle aperture by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of the radiation through the predetermined wall thickness thereof, and (iii) a predetermined color and opacity that causes the laser radiation at the predetermined wavelength and power to hermetically seal the needle aperture formed in the needle penetration region thereof in a predetermined time period of less than or equal to about 5 seconds and substantially without burning the needle penetration region.

In one embodiment, the stopper 40 is formed of a thermoplastic elastomer that is heat resealable to hermetically seal the needle aperture by applying laser radiation at a predetermined wavelength and power thereto, and includes (i) a styrene block copolymer; (ii) an olefin; (iii) a predetermined amount of pigment that allows the stopper to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and second material portion during needle penetration thereof. In one such embodiment, the stopper includes less than or equal to about 40% by weight styrene block copolymer, less than or equal to about 15% by weight olefin, less than or equal to about 60% by weight mineral oil, and less than or equal to about 3% by weight pigment and any processing additives of a type known to those of ordinary skill in the pertinent art.

In one embodiment, the stopper 40 is made of a thermoplastic elastomer that is heat resealable to hermetically seal the needle aperture by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an mount that allows the second material portion to substantially absorb laser radiation at the predetermined wavelength and substantially prevent the passage of radiation through the predetermined wall thickness thereof, and hermetically seal a needle aperture formed in the needle penetration region thereof in a predetermined time period of less than or equal to about 5 seconds; and (iv) a lubricant in an amount that reduces friction forces at an interface of the needle and second material portion during needle penetration thereof In one embodiment, the pigment is sold under the brand name Lumogen™ IR 788 by BASF Aktiengesellschaft of Ludwigshafen, Germany. The Lumogen IR products are highly transparent selective near infrared absorbers designed for absorption of radiation from semi-conductor lasers with wavelengths near about 800 nm. In this embodiment, the Lumogen pigment is added to the elastomeric blend in an amount sufficient to convert the radiation to heat, and melt the stopper material, preferably to a depth equal to at least about ⅓ to about ½ of the depth of the needle hole, within a time period of less than or equal to about 5 seconds, preferably less than about 3 seconds, and most preferably less than about 1½ seconds. The Lumogen IR 788 pigment is highly absorbent at about 788 nm, and therefore in connection with this embodiment, the laser preferably transmits radiation at about 788 nm (or about 800 nm). One advantage of the Lumogen IR 788 pigment is that very small amounts of this pigment can be added to the elastomeric blend to achieve laser resealing within the time periods and at the resealing depths required or otherwise desired, and therefore, if desired, the needle penetrable and laser resealable stopper may be transparent or substantially transparent. This may be a significant aesthetic advantage. In one embodiment of the invention, the Lumogen IR 788 pigment is added to the elastomeric blend in a concentration of less than about 150 ppm, is preferably within the range of about 10 ppm to about 100 ppm, and most preferably is within the range of about 20 ppm to about 80 ppm. In this embodiment, the power level of the 800 nm laser is preferably less than about 30 Watts, or within the range of about 8 Watts to about 18 Watts.

Preferably the material used to form the stopper is selected from materials (i) that are regulatory approved for use in connection with the respective contact lens, solution, and predetermined substance to be added thereto, and preferably for direct contact with each such item, and (ii) that do not leach an undesirable level of contaminants or non-regulatory approved leachables into the contact lens, solution and/or predetermined substance. Exemplary materials for the stopper 40 are selected from the group including GLS 254-071, C-Flex R70-001, Evoprene TS 2525 4213, Evoprene SG 948 4213 and Cawiton 7193, modifications of any of the foregoing, or similar thermoplastic elastomers. As may be recognized by those or ordinary skill in the pertinent art based on the teachings herein, these materials are only exemplary, and numerous other materials that are currently known, or that later become known, equally may be used.

As may be recognized by those skilled in the pertinent art based on the teachings herein, numerous changes and modifications may be made to the above-described and other embodiments of the present invention without departing from its scope as defined in the appended claims. For example, the resealable stopper may be integrally molded with the body such as by co-molding (e.g., over molding the stopper to the filling boss or vice-versa) or insert molding. Alternatively, the resealable stopper may be fused or otherwise melted to the body, or the resealable stopper may be sequentially molded to the body. In addition, the resealable stopper may be made of any of numerous different materials that are currently known, or that later become known for performing the functions of the resealable stopper described herein, such as any of numerous different thermoplastic and/or elastomeric materials, including, for example, low-density polyethylene. Similarly, the stopper may be formed with plural layers, such as an inner layer that is compatible with the contact lens solution and/or predetermined substance within the container, and an outer layer that is needle penetrable and laser resealable. The inner layer of the stopper can be made of vulcanized rubber, silicon, or any of numerous other materials that are currently known, or later become known as being compatible with, or otherwise defining a stable enclosure for the particular contact lens, contact lens solution and/or predetermined substance within the container. In addition, the sealing station may employ any of numerous different types of heat sources that are currently known, or that later become known, for performing the function of the heat sources described herein, such as any of numerous different types of laser or other optical sources or conductive heat sources. Also the contact lens, the contact lens solution or the packing solution, and the predetermined substance added to the container, can be any of numerous different types of contact lenses, solutions, and/or substances that are currently known, or that later become known. Accordingly, this detailed description of the currently preferred embodiments is to be taken in an illustrative, as opposed to a limiting sense.

What is claimed is:

1. A contact lens container for sealing within it a contact lens in a solution, and configured for use with an apparatus including a needle for penetrating the container and introducing through the needle a predetermined substance therein into contact with at least one of the contact lens and solution, and a laser for transmitting radiation onto a penetrated region of the container to thermally reseal the penetrated region and, in turn, seal the contact lens, solution, and predetermined substance within the container, the container comprising:

a body defining a chamber;

a contact lens and a contact lens solution received within the chamber;

a substantially fluid-tight seal formed between the chamber and ambient atmosphere to seal the contact lens and solution within the chamber;

a needle penetrable and laser resealable stopper located on the body in fluid communication with the chamber, wherein the stopper is penetrable by the needle to introduce the predetermined substance through the needle and into the chamber, and a penetrated region of the stopper is thermally resealable by application of radiation from the laser thereto to reseal the stopper and, in turn, seal the contact lens, solution and predetermined substance within the chamber.

2. A contact lens container as defined in claim 1, further comprising the predetermined substance.

3. A contact lens container as defined in claim 1, wherein the needle penetrable and laser resealable stopper includes an inner layer in fluid communication with the chamber that is compatible with the contact lens, solution and the predetermined substance, and an outer layer that is needle penetrable and laser resealable.

4. A contact lens container as defined in claim 3, wherein the inner layer does not leach more than a predetermined amount of leachables into at least one of the contact lens, solution and predetermined substance.

5. A contact lens container as defined in claim 2, wherein the body includes a base surface forming a base portion of the chamber, the base surface defines at least one substantially convex portion that supports a substantially concave surface of the contact lens thereon and defines an interface therebetween, and the interface is in fluid communication with the stopper for receiving the predetermined substance therein.

6. A contact lens container as defined in claim 5, wherein the interface contains a greater concentration of the predetermined substance than the other portions of the chamber.

7. A contact lens container as defined in claim 6, wherein the concave side of the contact lens defining the interface includes a greater concentration of the predetermined substance than does the opposing convex side of the contact lens.

8. A contact lens container as defined in claim 5, wherein the base surface defines a plurality of relatively raised surface areas and relatively recessed surfaces areas between relatively raised surface areas, and the relatively recessed surface areas are in fluid communication with the stopper for receiving predetermined substance therein.

9. A contact lens container as defined in claim 8, wherein the relatively recessed surface areas are defined by substantially radially extending recesses, and the body further defines a fluid passageway in fluid communication between the recesses and the stopper for introducing the predetermined substance therethrough and into the recesses.

10. A contact lens container as defined in claim 2, wherein the predetermined substance is selected from the group consisting of a preservative; a chelating agent; an anionic component; a cationic component; a zwitterionic component; an acid; a base; an alcohol; a glycol; a polymeric agent; a reducing agent; a salt; a surfactant; an antioxidant; a cleaning agent; a disinfecting agent; a wetting agent; a hydrating agent; a coloring agent; an ultraviolet absorbing agent; a gas; a lipid; an oil; a phospholipid; a lubricant; a buffering agent; a mineral; a nutrient; a vitamin; a biological macromolecule; a small molecule; an antibiotic; a biopolymer; a protein; and a nucleic acid.

11. A contact lens container as defined in claim 1, wherein the stopper includes a thermoplastic elastomer that is heat resealable to hermetically seal the penetrated region by applying laser radiation at a predetermined wavelength and power thereto, and defines (i) a predetermined wall thickness, (ii) a predetermined color and opacity that substantially absorbs the laser radiation at the predetermined wavelength and substantially prevents the passage of the radiation through the predetermined wall thickness thereof, and (iii) a predetermined color and opacity that causes the laser radiation at the predetermined wavelength and power to hermetically seal the penetrated region in a predetermined time period of less than or equal to about 5 seconds and substantially without burning the stopper.

12. A contact lens container as defined in claim 1, wherein the stopper includes a thermoplastic elastomer that is heat resealable to hermetically seal the needle aperture by applying laser radiation at a predetermined wavelength and power thereto, and includes (i) a styrene block copolymer; (ii) an olefin; (iii) a predetermined amount of pigment that allows the second material portion to substantially absorb laser radiation at the predetermined wavelength and substantially prevent the passage of radiation through the predetermined wall thickness thereof, and hermetically seal the needle aperture formed in the needle penetration region thereof in a predetermined time period of less than or equal to about 5 seconds; and (iv) a predetermined amount of lubricant that reduces friction forces at an interface of the needle and stopper during needle penetration thereof.

13. A contact lens container as defined in claim 1, wherein the stopper includes a thermoplastic elastomer that is heat resealable to hermetically seal the penetrated region thereof by applying laser radiation at a predetermined wavelength and power thereto, and includes (i) a first polymeric material in an amount within the range of about 80% to about 97% by weight and defining a first elongation; (ii) a second polymeric material in an amount within the range of about 3% to about 20% by weight and defining a second elongation that is less than the first elongation of the first polymeric material; (iii) a pigment in an mount that allows the second material portion to substantially absorb laser radiation at the predetermined wavelength and substantially prevent the passage of radiation through the predetermined wall thickness thereof, and hermetically seal the penetrated region in a predetermined time period of less than or equal to about 5 seconds; and (iv) a lubricant in an amount that reduces friction forces at an interface of the needle and stopper during needle penetration thereof.

14. An assembly comprising a contact lens container as defined in claim 1; a filling apparatus comprising a needle manifold including a plurality of needles spaced relative to each other and movable relative to a container support for penetrating a plurality of containers mounted on the support within the filling apparatus, introducing the predetermined substance into the containers through the needles, and withdrawing the needles from the filled containers; and a plurality of laser optic assemblies, wherein each laser optic assembly is connectable to a source of laser radiation, and is focused substantially on a penetration spot of the respective stopper for applying laser radiation thereto and resealing the respective penetrated region.

15. A contact lens container for sealing within it a contact lens in a solution, and configured for use with an apparatus including a needle for penetrating the container and introducing through the needle a predetermined substance therein into contact with at least one of the contact lens and solution, and a laser for transmitting radiation onto a penetrated region of the container to thermally reseal the penetrated region and, in turn, seal the contact lens, solution, and predetermined substance within the container, the container comprising:

first means for forming a chamber;

a contact lens and a contact lens solution received within the chamber;

a substantially fluid-tight seal between the chamber and ambient atmosphere to seal the contact lens and solution within the chamber;

second means in fluid communication with the chamber for penetration by the needle to introduce the predetermined substance through the needle and into the chamber, and for thermal resealing by application of radiation from the laser thereto to reseal the second means and, in turn, seal the contact lens, solution and predetermined substance within the chamber.

16. A contact lens container as defined in claim 15, wherein the first means is a body, and the second means is a needle penetrable and laser resealable stopper in fluid communication with the chamber that is penetrable by the needle to introduce the predetermined substance through the needle and into the chamber and is thermally resealable by application of radiation from the laser thereto to reseal a penetrated region of the stopper and, in turn, seal the contact lens, solution and predetermined substance within the chamber.

17. A method of providing a contact lens container containing therein a contact lens and a solution, and adding thereto a predetermined substance, the method comprising the following steps:

providing a contact lens container including a body defining a contact lens storage chamber, and a needle penetrable and laser resealable stopper in fluid communication with the chamber;

introducing the contact lens and solution into the chamber, and sealing the contact lens and solution within the chamber relative to the ambient atmosphere;

inserting a needle through the stopper and into fluid communication with the chamber;

introducing the predetermined substance through the needle and into the chamber;

withdrawing the needle from the stopper; and applying laser radiation to a penetrated region of the stopper, thermally resealing the penetrated region of the stopper and, in turn, sealing the contact lens, solution and predetermined substance within the chamber.

18. A method as defined in claim 17, further comprising the step of terminally sterilizing the contact lens container with the contact lens and solution sealed therein prior to introducing the predetermined substance into the container.

19. A method as defined in claim 18, further comprising the step of introducing the predetermined substance into an interface formed between a substantially concave surface of the contact lens and a wall of the chamber, and at least one of (i) impregnating at least a portion of the predetermined substance into the concave surface of the contact lens, and (ii) depositing at least a portion of the predetermined substance onto the concave surface of the contact lens.

20. A method as defined in claim 19, further comprising the step of applying a greater amount of the predetermined substance to the concave side of the contact lens in comparison to the opposing convex side of the contact lens.

21. A method as defined in claim 20, further comprising the step of applying the concave side of the contact lens into contact with a user's cornea such that a greater amount of the predetermined substance is located within the interface between the concave side of the contact lens and the eye in comparison to the opposite convex side of the contact lens.

* * * * *